US008132350B1

(12) United States Patent
Alves

(10) Patent No.: US 8,132,350 B1
(45) Date of Patent: Mar. 13, 2012

(54) HAMMER SPRING ASSEMBLY FOR A FIREARM

(76) Inventor: Joseph E. Alves, Springfield, OR (US)

( * ) Notice: Subject to any disclaimer, the term of this patent is extended or adjusted under 35 U.S.C. 154(b) by 172 days.

(21) Appl. No.: 12/498,551

(22) Filed: Jul. 7, 2009

Related U.S. Application Data

(60) Provisional application No. 61/078,720, filed on Jul. 7, 2008.

(51) Int. Cl.
*F41A 19/10* (2006.01)

(52) U.S. Cl. ..... 42/69.03

(58) Field of Classification Search ..... 42/69.03
See application file for complete search history.

(56) References Cited

U.S. PATENT DOCUMENTS

| | | | | |
|---|---|---|---|---|
| 287,229 | A | 10/1883 | Bullard | |
| 993,175 | A * | 5/1911 | Knotgen | 89/126 |
| 1,704,889 | A * | 3/1929 | Gardiner | 42/69.03 |
| 2,364,232 | A * | 12/1944 | Mills | 42/44 |
| 3,377,731 | A | 4/1968 | Lawrence | |
| 3,726,040 | A | 4/1973 | Cranston | |
| 3,863,375 | A * | 2/1975 | Browning | 42/69.01 |
| 4,040,196 | A | 8/1977 | Smith et al. | |
| 4,128,957 | A | 12/1978 | Lee | |
| 4,391,057 | A | 7/1983 | Bornancini | |
| 4,908,970 | A | 3/1990 | Bell | |
| 5,012,604 | A | 5/1991 | Rogers | |
| 5,548,914 | A | 8/1996 | Anderson | |
| 5,682,699 | A | 11/1997 | Gentry | |
| 5,724,759 | A * | 3/1998 | Kilham | 42/66 |
| 7,181,880 | B2 | 2/2007 | Keeney | |
| 7,430,827 | B1 | 10/2008 | Huber | |
| 7,526,889 | B2 | 5/2009 | Metzger et al. | |

OTHER PUBLICATIONS http://www.pioneergunworks.com/Main_Spring_Conversion.html entitled "Main Spring Conversion" downloaded and printed Jul. 6, 2009.

"Installing a Pioneer Gun Works Coil Mainspring Conversion Kit—Model 1866 Uberti Rifle" instruction sheet published Oct. 2008.

"Installing a Pioneer Gun Works Coil Mainspring Conversion Kit—Model 1873 Uberti Rifle" instruction sheet published Oct. 2008.

* cited by examiner

*Primary Examiner* — Stephen M Johnson
(74) *Attorney, Agent, or Firm* — David S. Alavi

(57) ABSTRACT

A hammer spring assembly comprises a spring and a member operatively coupling the spring and a hammer of a firearm when the hammer spring assembly is connected to a firearm. The hammer is biased by the spring to rotate forward toward a cartridge or firing pin. The spring exerts a bias force on the member in the forward direction, which urges the member against a curved rearward surface of the hammer at a hammer contact point. As the hammer rotates rearward, the hammer contact point moves along the rearward hammer surface so as to cause a desired variation of an effective lever arm about the hammer pivot point of the bias force exerted on the hammer. Methods comprise connecting the hammer spring assembly to a firearm, or providing the hammer spring assembly and instructing a user to connect it to a firearm.

28 Claims, 7 Drawing Sheets

112
118
130
110
132
116
114
144
142
126
120
100
124
122

HAMMER SPRING ASSEMBLY FOR A FIREARM

BENEFIT CLAIMS TO RELATED APPLICATIONS

This application claims benefit of prior-filed provisional App. No. 61/078,720 filed Jul. 7, 2008 in the name of Joseph Edward Alves and entitled "Constant tension, variable leverage compression spring assembly used for driving the hammer and firing assembly in a lever action rifle," said provisional application being hereby incorporated by reference as if fully set forth herein.

BACKGROUND

The field of the present invention relates to firearms. In particular, hammer spring assemblies for firearms are described herein that provide a varying lever arm for exerting a spring force on a hammer of a firearm.

A wide variety of hammer spring assemblies or arrangements are used for firearms of various types. Some of these are described in:

U.S. Pat. No. 287,229 entitled "Magazine gun" issued Oct. 23, 1883 to Bullard;

U.S. Pat. No. 3,377,731 entitled "Lever action trigger system" issued Apr. 16, 1968 to Lawrence;

U.S. Pat. No. 3,726,040 entitled "Gun trigger mechanism" issued Apr. 10, 1973 to Cranston;

U.S. Pat. No. 4,040,196 entitled "Rifle" issued Aug. 9, 1977 to Smith et al;

U.S. Pat. No. 4,128,957 entitled "Revolver-type handgun" issued Dec. 12, 1978 to Lee;

U.S. Pat. No. 4,391,057 entitled "Actuator system for the return of the trigger in double-action revolvers" issued Jul. 5, 1983 to Bornancini;

U.S. Pat. No. 4,908,970 entitled "Gun trigger" issued Mar. 20, 1990 to Bell;

U.S. Pat. No. 5,012,604 entitled "Trigger assembly" issued May 7, 1991 to Rogers;

U.S. Pat. No. 5,548,914 entitled "Gun trigger mechanism" issued Aug. 27, 1996 to Anderson;

U.S. Pat. No. 5,682,699 entitled "Single-shot falling block action rifle with improved safety" issued Nov. 4, 1997 to Gentry;

U.S. Pat. No. 7,181,880 entitled "Roller sear/hammer interface for firearms" issued Feb. 27, 2007 to Keeney;

U.S. Pat. No. 7,430,827 entitled "Gun trigger" issued Oct. 7, 2008 to Huber; and U.S. Pat. No. 7,526,889 entitled "Trigger mechanism for handguns" issued May 5, 2009 to Metzger et al.

In the patents listed above, the hammer spring assembly exerts a spring force on the hammer at a fixed point on the hammer. Typically, the spring force is exerted by the spring or a spring-driven member at a pivot point fixed on the hammer or at a detent or depression on the hammer. In either case, the effective lever arm of the spring force on the hammer does not change as the hammer rotates. The user-applied torque required to cock the hammer against the spring force therefore typically increases (with increasing spring force as the spring is compressed) as the hammer rotates in a rearward direction as it is cocked.

SUMMARY

A hammer spring assembly for a firearm comprises a spring and a member arranged, when the hammer spring assembly is connected to a firearm, to operatively couple the spring and a hammer of the firearm. The hammer is pivotably connected to the firearm, and the spring, when the hammer spring assembly is connected to a firearm, biases rotation of the hammer about a hammer pivot point in a forward direction toward a cartridge or firing pin. The member and the spring are arranged so that the spring exerts a bias force on the member in the forward direction. The member is arranged, when the hammer spring assembly is connected to a firearm, so that the bias force urges the member against a curved rearward surface of the hammer at a hammer contact point to exert the bias force on the hammer. The member and the spring are arranged relative to the hammer, when the hammer spring assembly is connected to a firearm, so that as the hammer rotates, the hammer contact point moves along the curved rearward surface of the hammer so as to cause a desired variation of an effective lever arm about the hammer pivot point of the bias force exerted on the hammer.

A method comprises connecting the hammer spring assembly to the firearm. Another method comprises providing the hammer spring assembly and instructing a user to connect it to the firearm.

Objects and advantages pertaining to firearm hammer spring assemblies may become apparent upon referring to the exemplary embodiments illustrated in the drawings and disclosed in the following written description or appended claims.

Figure 1:
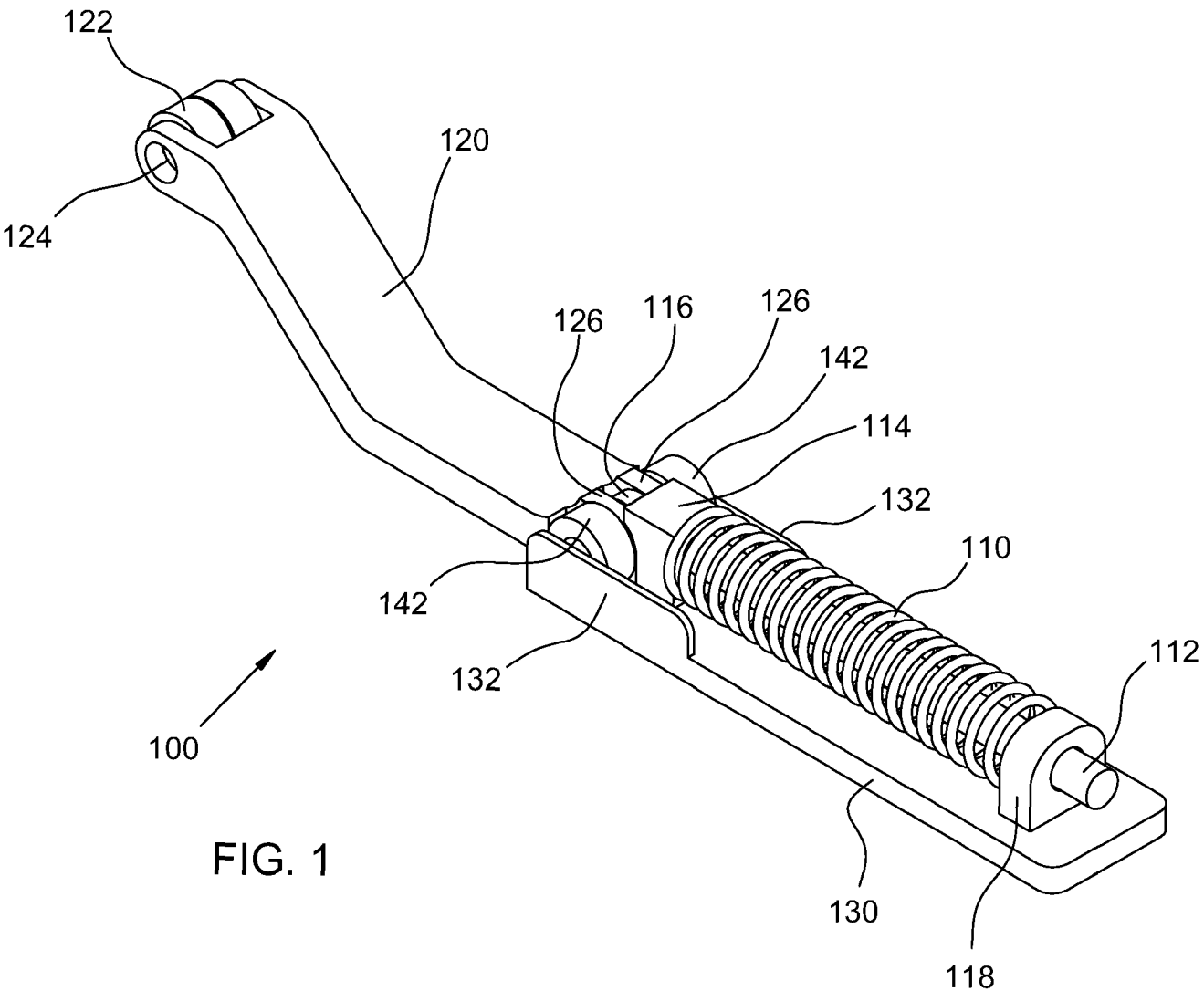
FIG. 1 is an isometric view of an exemplary hammer spring assembly.
Figures 2A, 2B, 2C:
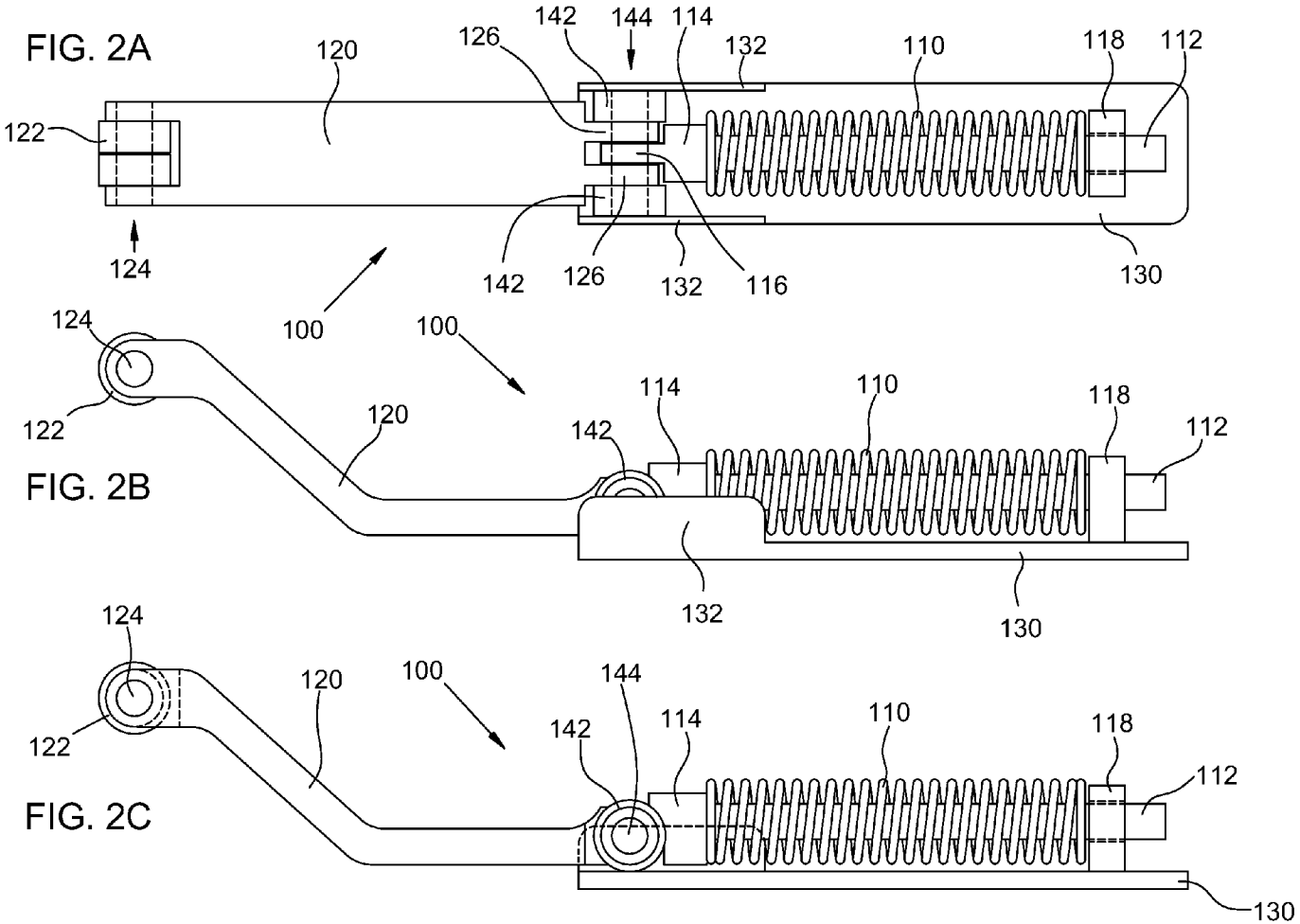
FIGS. 2A and 2B are a top and side views, respectively, of the exemplary hammer spring assembly.
FIG. 2C is the side view of FIG. 2B with portions shown as dashed lines to reveal structures hidden in FIG. 2B.
Figure 3A:
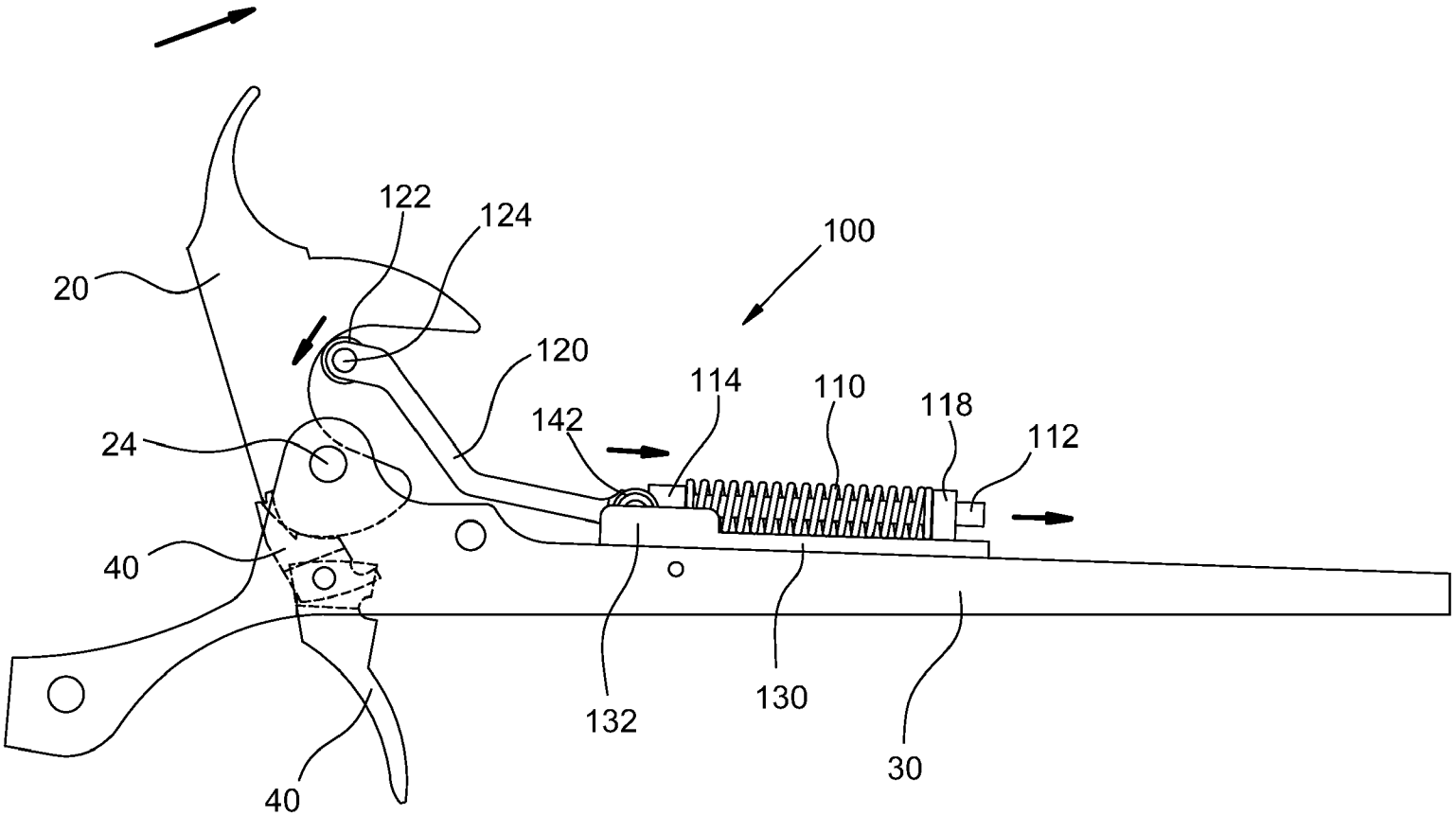
FIGS. 3A and 3B are side views of the exemplary hammer spring assembly mounted on a lower tang of a firearm receiver assembly along with a hammer of the firearm in forward and cocked positions, respectively.
Figure 3B:
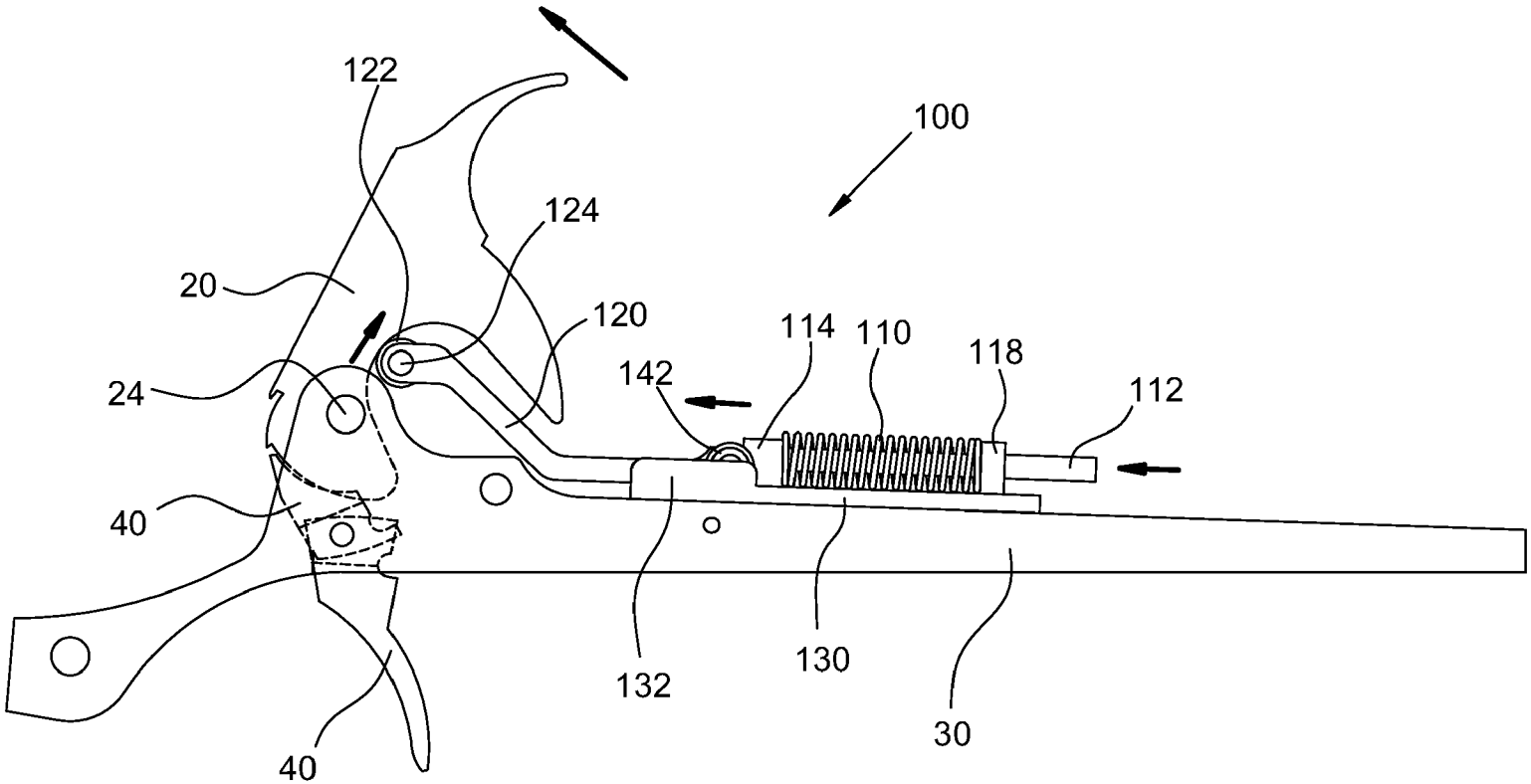
Figure 4A:
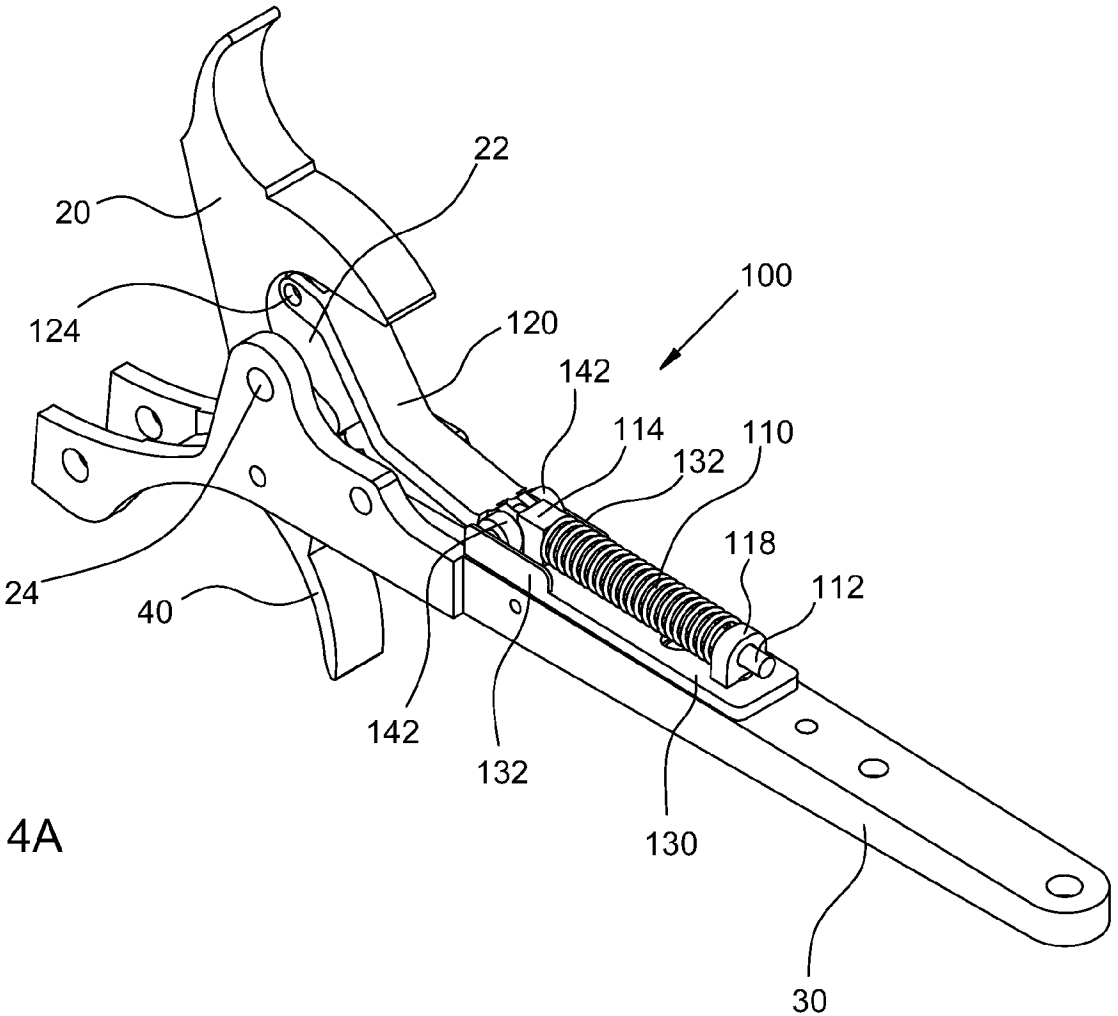
FIGS. 4A and 4B are isometric views of an exemplary hammer spring assembly mounted on a lower tang of a firearm receiver assembly along with a hammer of the firearm in forward and cocked positions, respectively.
Figure 4B:
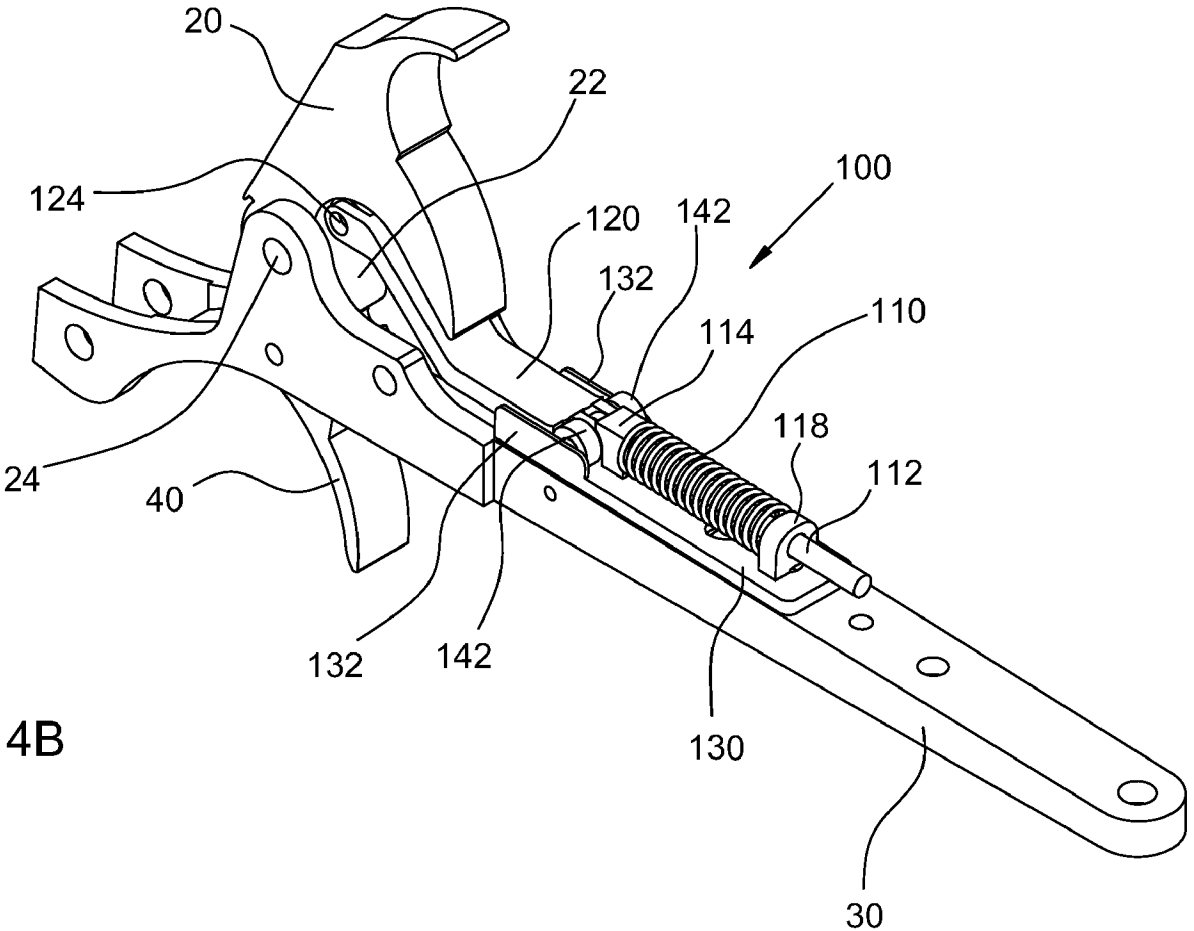

The embodiments shown in the Figures are exemplary, and should not be construed as limiting the scope of the present disclosure or appended claims. Unless specifically stated, the Figures should not be assumed to be to scale, and some relative sizes or proportions may be distorted for purposes of illustration or clarity.

DETAILED DESCRIPTION OF EMBODIMENTS

It has been recognized as desirable to provide a hammer spring assembly that exhibits less increase, no increase, or even a decrease in user-applied torque required to rotate the hammer in the rearward direction. In the firearms disclosed in the patents listed in the Background, the effective lever arm of a spring force urging the hammer forward is substantially constant, because the point on the hammer at which that force is exerted is fixed on the hammer. The spring typically is attached (directly or indirectly through an intermediate member) to the hammer at a pin or axle, or the spring or spring-driven member pushes against a detent or depression in the hammer. In either case, the distance between the hammer pivot point and the point at which the forward force is exerted remains substantially constant as the hammer rotates forward or rearward. As the spring is deformed further from its rest position, however, the force required to further distort the spring increases, e.g., substantially linearly according to Hooke's law. Other dependences (e.g., a nonlinear dependence) of the increasing force with spring deformation could be employed. The combination of a substantially constant lever arm and an increasing spring force results in an increasing torque (and therefore greater force) required to be exerted by the user to rotate the hammer in a rearward direction to its cocked position. Further, as the hammer is driven by the spring force to rotate forward to fire the firearm, the spring force becomes weaker, resulting in less spring-provided torque driving forward rotation of the hammer.

It would be desirable to reduce or eliminate the variation in the torque required to be applied by the user to rotate the hammer rearward to its cocked position. This result is achieved in the exemplary embodiments disclosed or claimed herein by a hammer spring assembly wherein, as the hammer rotates rearward to its cocked position, the effective lever arm decreases as the spring force increases. The combination of decreasing lever arm and increasing spring force results in a reduced variation of the net torque opposing the rearward hammer rotation, relative to an arrangement wherein the lever arm does not change. Further, by suitably tailoring the lever arm variation (decreasing and/or increasing) as a function of rearward hammer rotation, any desirable dependence of net torque versus rearward hammer rotation can be achieved (e.g., monotonically increasing or decreasing, concave up or down, passing through a maximum or a minimum, or combinations thereof). One possible desirable arrangement can yield substantially constant torque as the hammer rotates. Other arrangements can be implemented that result in increasing torque (but less so than that exhibited by a constant lever arm) or in decreasing torque, as the hammer rotates in the rearward direction. Because the "feel" of a firearm that results from a particular variation of torque with hammer rotation is highly subjective, many combinations of lever arm variation and spring force variation can be employed to achieve a wide array of torque variations, and the optimum choice among those torque variations will typically differ among individual users in a highly subjective way. Any such individually optimized torque variation shall fall within the scope of the present disclosure or appended claims.

The modification of the dependence of the applied torque on rearward rotation of the hammer can be implemented to achieve a variety of results. In some instances it may be desirable to maintain the torque required at the beginning of the rearward rotation at or near its original value, and to reduce the torque required at the end of the rearward rotation (i.e., near or at the cocked position). In an example that can achieve that result, the spring stiffness can remain unchanged while the hammer spring assembly is modified to provide a decreasing lever arm with rearward rotation. In other instances it may be desirable to increase the torque required at the beginning of the rearward rotation to a value similar to that required near or at the cocked position. In an example that can achieve that result, the spring stiffness can be increased while also modifying the hammer spring assembly to provide a decreasing lever arm with rearward rotation. Many other combinations of spring stiffness and lever arm variation can be combined to achieve a wide variety of results.

FIGS. 1 and 2A-2C illustrate an exemplary hammer spring assembly 100 that comprises a spring 110 and a member 120. FIGS. 3A-3B, 4A-4B, and 5 illustrate the hammer spring assembly 100 mounted on a lower tang 30 of a lever-action rifle 10 along with a hammer 20 and a trigger 40. The member 120 is arranged to operatively couple the spring 110 and the hammer 20, which is pivotably connected at a hammer pivot point 24 to the lower tang 30 so that the spring 110 biases rotation of the hammer 20 about the hammer pivot point 24 in a forward direction toward a cartridge or firing pin. "Forward" indicates the direction of fire of the firearm. The hammer spring assembly 100 can be mounted on any type of firearm that includes a spring-driven hammer (including rifles and handguns), and can be mounted on the firearm in any suitable way.

The member 120 and the spring 110 are arranged so that the spring 110 exerts a bias force on the member 120 in the forward direction. The member 120 is arranged so that the bias force in turn urges the member 120 against a curved rearward surface 22 of the hammer 20 at a hammer contact point to exert the bias force on the hammer. The hammer contact point is defined herein as that point on a rearward surface 22 of hammer 20 where the member 120 makes contact with the hammer 20 and exerts on the hammer 20 the spring bias force exerted by the spring 110 on the member 120.

The member 120 and the spring 110 are arranged relative to the hammer 20 so that, as the hammer 20 rotates in a rearward direction, the hammer contact point moves toward the hammer pivot point 24 along the curved rearward surface 22 of the hammer 20 so as to decrease an effective lever arm (i.e., the distance between the hammer contact point and the hammer pivot point 24) about the hammer pivot point of the bias force exerted on the hammer 20. Conversely, as the hammer 20 rotates in the forward direction, the hammer contact point moves away from the hammer pivot point 24 along the curved rearward surface 22 of the hammer 20 so as to increase the effective lever arm of the bias force exerted on the hammer 20.

The hammer spring assembly 100 can be connected directly to the lower tang 30 or to any other suitable portion of the firearm 10. Alternatively, the hammer spring assembly 100 can further comprise a base 130 arranged to be mounted on the firearm 10. If a base 130 is employed, the spring 110 is connected to the base 130. The base 130 is further arranged so that mounting the base 130 on the firearm 10 suitably arranges the member 120 and the spring 110 relative to the hammer 20, with the spring 110 exerting the bias force on the member 120 and the member 120 in turn exerting the bias force on the hammer 20.

A hammer spring assembly 100 that includes a base 130 can be particularly suitable for adapting or retrofitting an existing firearm 10 with a hammer spring assembly 100 in order to provide an altered variation of torque with hammer rotation. For example, the hammer spring assembly 100 with a base 130 can be mounted on a lower tang 30 of a Model 1860, 1866, or 1873 Winchester lever action rifle (or replica thereof; such replicas are manufactured by A. Uberti Firearms, for example). The bias force of spring 110 urges the member 120 against the curved rearward surface 22 of the hammer 20 of the Model 1860, 1866, or 1873 Winchester rifle or replica thereof. The firearm 10 shown in FIG. 5 substantially conforms to those Winchester models or replicas, and comprises a receiver assembly 60, lower tang 30, hammer 20, trigger 40, lever 80, stock 50, and barrel 70. Much of the action not directly linked to the hammer spring assembly 100 is hidden in FIG. 5; broken lines indicate where portions of the firearm are omitted from the drawing to reveal the arrangement of the hammer spring assembly 100. A hammer spring assembly 100 as disclosed or claimed herein, with or without a base 130, can be incorporated into any suitable new firearm as original equipment, or can be retrofitted into any suitable existing firearm.

Figure 6B:
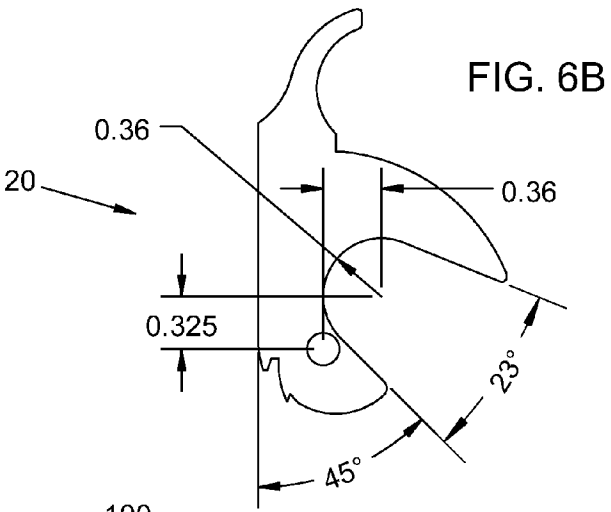
FIGS. 6A and 6B are side views of a hammer from a Winchester lever action rifle or replica thereof.
Figure 6A:
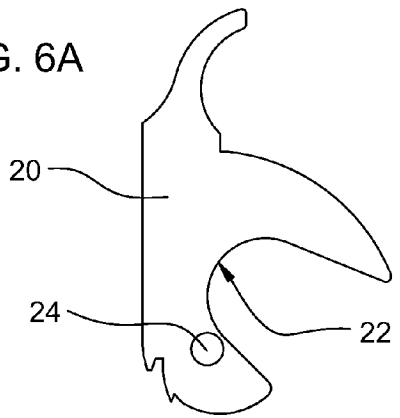
Figure 5:
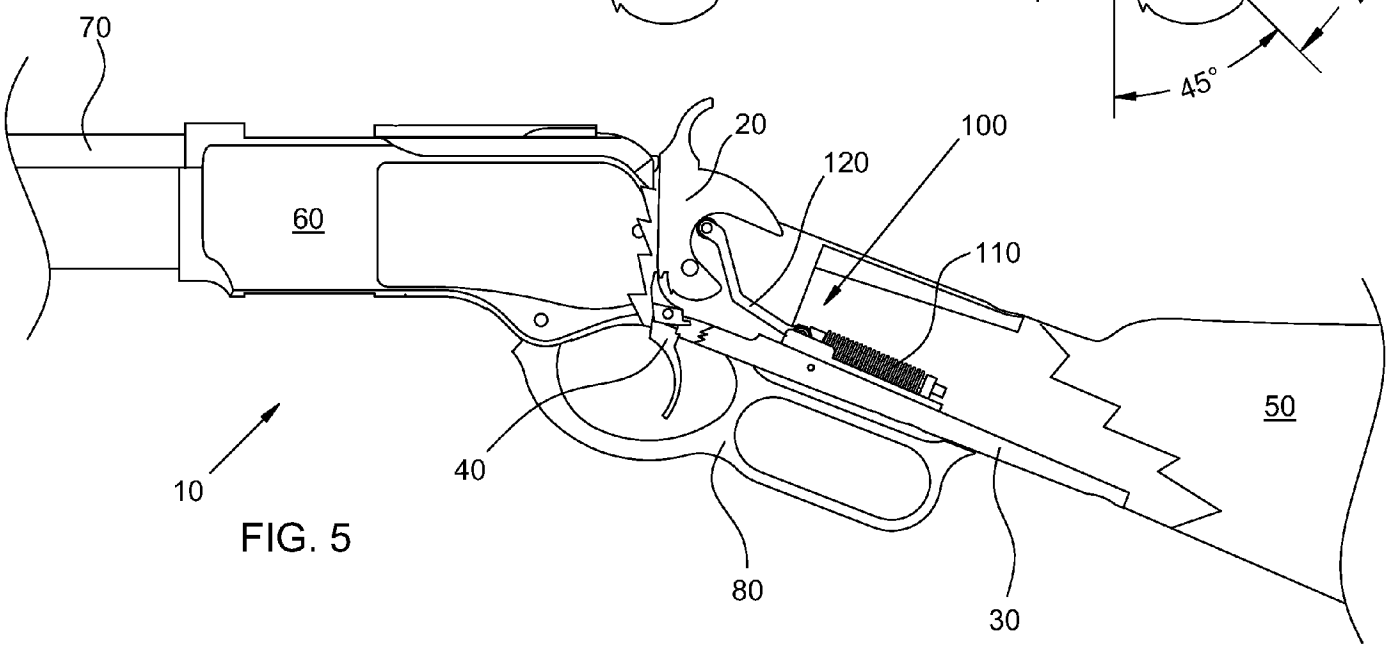
FIG. 5 is a side view of the exemplary hammer spring assembly mounted in a lever action rifle.

The hammer 20 for those Winchester models (or replicas) is shown in FIGS. 6A and 6B, with the dimensions shown (in inches) defining the shape of the rearward hammer surface 22 shown in FIG. 6B. The curved rearward surface of the hammer comprises two substantially straight portions and a concave circular arc portion tangent to the straight portions, wherein (i) the straight portions extend rearward and downward at angles of about 45° and about 68°, respectively, with respect to a vertical front surface of the hammer, and (ii) the circular arc portion has a radius of about 0.36 inches and a center of curvature about 0.325 inches above and about 0.36 inches behind the hammer pivot point. The rearward surface 22 of the hammer 20 shown in FIGS. 6A and 6B results in a lever arm that decreases with rearward hammer rotation and increases with forward hammer rotation, in a manner that reduces the variation in torque on the hammer with rotation of the hammer (relative to the original hammer spring assembly of a Winchester or replica rifle). In other embodiments of a firearm with a hammer spring assembly 100 (not shown), any other suitable shape of rearward hammer surface 22 can be employed to achieve any desired variation of lever arm with hammer rotation and a corresponding desired variation of torque with hammer rotation.

The member 120 can be arranged in any suitable way to couple the hammer 20 and the spring 110. For example, the spring 110 can be arranged under tension to pull the hammer 20 forward (not shown in the Figures). Another example includes a leaf spring arranged to urge forward rotation of hammer 20 (not shown in the Figures); the standard hammer spring assembly of the Winchester rifle models (or replicas) mentioned above employ a curved leaf spring arranged to push upward on a backward projection of hammer 20. Another example (shown in the Figures) includes a spring 110 under compression connected to the firearm 10 (directly or via a base 130) at the rearward end of the spring 110. The member 120 comprises a strut arranged to push against the hammer 20 with a forward end of the strut 120 at the hammer contact point and with a rearward end of the strut 120 connected to the spring 110. The compressed spring 110 exerts a force on the rearward end of strut 120, which in turn exerts the spring bias force on the hammer 20 with the front end of the strut 120 pushing against the curved rearward surface 22 of the hammer 20. The strut 120 shown in the Figures is bent in two places to accommodate the particular shape of the Winchester (or replica) hammer 20 as it rotates. However, any suitable shape can be employed that enables the strut to exert the spring bias force on the hammer 20 and to accommodate the shape and rotation of the hammer 20.

As the hammer 20 is rotated by a user rearward toward its cocked position, the front end of the strut 120 (defining the hammer contact point) moves along the rearward surface 22 of the hammer 20. The shape of the rearward hammer surface 22 causes the hammer contact point to move closer to the hammer pivot point 24 as the hammer rotates rearward, thus decreasing the effective moment arm of the spring bias force about the hammer pivot point 24. That reduction of moment arm occurs as the spring bias force increases (as the spring 110 is further compressed). The combination of decreasing moment arm and increasing spring bias force results in torque on the hammer that increases less than if the moment arm were constant (or remains constant or decreases, depending on the shape of rearward hammer surface 22). Conversely, the decrease in torque on the hammer 20 as it rotates forward from its cocked position is less than if there were no lever arm variation (or substantially eliminated, or even reversed).

The strut 120 can further comprise one or more rolling bearings 142 at the connection between the strut 120 and the spring 110. The rolling bearings 142 are arranged to guide forward and rearward movement of a connection point between the strut 120 and the spring 110 and can be of any suitable type. Rolling bearings 142 can be rotatably mounted on a shaft or axle 144 at the rearward end of the strut 120. Ball bearings (i.e., concentric circular races with spherical balls rolling between them) can be employed, or any other type of suitable rolling bearing can be employed. A pair of rolling bearings 142 are shown in the Figures mounted on either side of the strut 120 and spring 110; any other suitable number, type, or arrangement of the rolling bearings can be employed. To facilitate movement of the front end of the strut 120 along the rearward hammer surface 22, the strut 120 can be pivotably connected at its rearward end to the spring 110. A clevis and pin arrangement is shown in the example in the Figures, with strut 120 having at its rearward end a clevis formed by members 126. The clevis engages member 116 (mounted on block 114) at the forward end of spring 110 using the shaft or axle 144, or an additional shaft or axle can be employed if needed, desirable, or suitable to engage members 116 and 126. Any other suitable joint or connection can be formed between strut 120 and spring 110 that enables pivoting motion between them. In the example shown in the Figures, base 130 includes lateral guides 132 arranged to restrict or prevent lateral movement of rolling bearings 142 (and hence the forward end of the spring 110 and the rearward end of the strut 120) as they move forward and rearward along the base 130. Other suitable arrangements for restricting or guiding the motion of the strut 120 and the spring 110 can be employed.

Sliding engagement of the member 120 with the rearward hammer surface 22 at the moving hammer contact point can cause undesirable friction or wear. To facilitate movement of the member 120 along the rearward hammer surface 22 and to reduce wear, the member 120 can further comprise one or more rolling bearings 122. The rolling bearings 122 are rotatably connected to the member 120 and are arranged to roll along the rearward surface 22 of the hammer 20 at the hammer contact point as the hammer 20 rotates. Rolling bearings 122 can be rotatably mounted on a shaft or axle 124 on the member 120. If member 120 comprises a strut arranged to push against the rearward hammer surface 22, then the rolling bearings 122 can be mounted on shaft or axle 124 at the front end of strut 120. Ball bearings (i.e., concentric circular races with spherical balls rolling between them) can be employed, or any other type of suitable rolling bearing can be employed. A pair of rolling bearings 122 on the shaft 124 are shown in the Figures mounted in a clevis formed at the forward end of strut 120; any other suitable number, type, or arrangement of the rolling bearings can be employed.

Any type of spring 110 can be employed in any suitable or desired arrangement. In the exemplary hammer spring assembly 100 shown in the Figures, spring 110 comprises a compressed coil spring. Such a coil spring can be secured at its rearward end to the firearm 10 or to the base 130 in any suitable way. In the example of the Figures, spring 110 further comprises a spring shaft 112 positioned longitudinally within the coil spring 110, and a spring shaft guide 118 arranged to receive therethrough the spring shaft 112. The spring shaft guide 118 secures the coil spring 110 to the base 130 while permitting reciprocating motion of the spring shaft 112. The spring shaft has a block 114 at its forward end that does not fit through the coil spring 110, and member 116 is connected to block 114. The member 116 pivotably connects the forward end of the spring 110 (via block 114 on spring shaft 112) to the rearward end of the member 120 with clevis members 126 and shaft 144.

The components of the hammer spring assembly 100 can be fabricated using any suitable materials providing sufficient stiffness or strength. Steel is often employed to form strut 120, spring shaft 112, and base 130, for example. Spring 110 often comprises a suitable spring steel. Any other suitable materials can be employed, including other metals or alloys, or non-metallic materials such as composites.

None of the firearms disclosed in the patents listed in the Background includes a hammer spring assembly wherein the lever arm of the spring force exerted on the hammer changes with rotation of the hammer. None of the firearms disclosed in the patents listed in the Background includes a hammer spring assembly wherein the point of application of a forward spring force on the hammer moves along a curved rearward surface of the hammer as the hammer rotates, thereby changing the effective lever arm of the spring force on the hammer.

A method comprises connecting the hammer spring assembly to the firearm, and can be performed by a firearm manufacturer or technician, a gunsmith, a firearm repair shop, or an owner or other end user of the firearm. Another method comprises providing the hammer spring assembly and instructing a user to connect it to the firearm. Said user can be or be employed by a firearm manufacturer or technician, a gunsmith, a firearm repair shop, or an owner or other end user of the firearm. Instruction sheets for installing a hammer spring assembly into Model 1866 and Model 1873 Uberti rifles, published October 2008 by Pioneer Gun Works Inc., are hereby incorporated by reference as if fully set forth herein. Instructions posted online at http://www.pioneergunworks.com/Main_Spring_Conversion.html are also incorporated by reference as if fully set forth the herein.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or", "only one of . . . ", or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof shall be construed as open ended terminology, with the same meaning as if the phrase "at least" were appended after each instance thereof.

What is claimed is:

1. A hammer spring assembly for a firearm, the assembly comprising:

a spring;

a member comprising a strut with a rearward end connected to the spring and arranged, when the hammer spring assembly is connected to a firearm, to operatively couple the spring and a hammer pivotably connected to the firearm so that the spring biases rotation of the hammer about a hammer pivot point in a forward direction toward a cartridge or firing pin; and one or more rolling bearings at a connection point between the strut and the spring that are arranged to guide forward and rearward movement of the connection point between the strut and the spring, wherein:

the member is arranged to push against the hammer with a forward end of the strut at the hammer contact point;

the member and the spring are arranged so that the spring exerts a bias force on the member in the forward direction;

the member is arranged so that, when the hammer spring assembly is connected to the firearm, the bias force urges the member against a curved rearward surface of the hammer at a hammer contact point to exert the bias force on the hammer; and the member and the spring are arranged relative to the hammer, when the hammer spring assembly is connected to the firearm, so that as the hammer rotates, the hammer contact point moves along the curved rearward surface of the hammer so as to cause a desired variation of an effective lever arm about the hammer pivot point of the bias force exerted on the hammer to rotate the hammer in the forward direction.

2. The assembly of claim 1 wherein the member and the spring are arranged relative to the hammer, when the hammer spring assembly is connected to the firearm, so that (i) as the hammer rotates in a rearward direction, the hammer contact point moves along the curved rearward surface of the hammer so as to decrease the effective lever arm of the bias force exerted on the hammer, and (ii) as the hammer rotates in the forward direction, the hammer contact point moves along the curved rearward surface of the hammer so as to increase the effective lever arm of the bias force exerted on the hammer.

3. The assembly of claim 1 further comprising a base arranged to be mounted on the firearm, wherein:

the spring is connected to the base; and the base is further arranged so that mounting the base on the firearm arranges the member and the spring relative to the hammer with the spring exerting the bias force on the member and the member exerting the bias force on the hammer.

4. The assembly of claim 3 wherein the base is arranged to be mounted on a lower tang of a rifle so that the bias force urges the member against the curved rearward surface of the hammer, wherein (i) the curved rearward surface of the hammer comprises two substantially straight portions and a concave circular arc portion tangent to the straight portions, (ii) the straight portions extend rearward and downward at angles of about 45° and about 68°, respectively, with respect to a vertical front surface of the hammer, and (iii) the circular arc portion has a radius of about 0.36 inches and a center of curvature about 0.325 inches above and about 0.36 inches behind the hammer pivot point.

5. The assembly of claim 1 further comprising a firearm and a hammer thereof, wherein the hammer spring assembly is connected to the firearm.

6. The assembly of claim 1 wherein the one or more rolling bearings are rotatably mounted on a bearing shaft, and the strut is pivotably connected at its rearward end to the spring by the bearing shaft.

7. The assembly of claim 1 wherein the member comprises one or more rolling bearings rotatably connected to the member and arranged, when the hammer spring assembly is connected to the firearm, to roll along the rearward surface of the hammer at the hammer contact point as the hammer rotates.

8. The assembly of claim 1 wherein the spring comprises a coil spring.

9. The assembly of claim 8 further comprising a spring shaft positioned longitudinally within the coil spring and a spring shaft guide arranged to receive therethrough the spring shaft and to permit reciprocating motion of the spring shaft.

10. The assembly of claim 9 wherein a forward end of the spring shaft is connected to a rearward end of the member.

11. The assembly of claim 1 further comprising the hammer, wherein (i) the curved rearward surface of the hammer comprises two substantially straight portions and a concave circular arc portion tangent to the straight portions, (ii) the straight portions extend rearward and downward at angles of about 45° and about 68°, respectively, with respect to a vertical front surface of the hammer, and (iii) the circular arc portion has a radius of about 0.36 inches and a center of curvature about 0.325 inches above and about 0.36 inches behind the hammer pivot point.

12. The assembly of claim 1 wherein the member is arranged to exert the bias force on the hammer at only a single hammer contact point that moves substantially continuously along the curved rearward surface of the hammer as the hammer rotates.

13. A method comprising connecting a hammer spring assembly to a firearm, wherein:

the hammer spring assembly comprises (i) a spring and (ii) a member arranged to operatively couple the spring and a hammer pivotably connected to the firearm so that the spring biases rotation of the hammer about a hammer pivot point in a forward direction toward a cartridge or firing pin;

the member and the spring are arranged so that the spring exerts a bias force on the member in the forward direction;

the member is arranged so that the bias force urges the member against a curved rearward surface of the hammer at a hammer contact point to exert the bias force on the hammer;

the member and the spring are arranged relative to the hammer, when the hammer spring assembly is connected to the firearm, so that as the hammer rotates, the hammer contact point moves along the curved rearward surface of the hammer so as to cause a desired variation of an effective lever arm about the hammer pivot point of the bias force exerted on the hammer to rotate the hammer in the forward direction;

the member comprises a strut arranged to push against the hammer with a forward end of the strut at the hammer contact point and with a rearward end of the strut connected to the spring;

the hammer spring assembly further comprises one or more rolling bearings at a connection point between the strut and the spring that are arranged to guide forward and rearward movement of the connection point between the strut and the spring; and the one or more rolling bearings are rotatably mounted on a bearing shaft, and the strut is pivotably connected at its rearward end to the spring by the bearing shaft.

14. The method of claim 13 wherein the member and the spring are arranged relative to the hammer, when the hammer spring assembly is connected to the firearm, so that (i) as the hammer rotates in a rearward direction, the hammer contact point moves along the curved rearward surface of the hammer so as to decrease the effective lever arm of the bias force exerted on the hammer, and (ii) as the hammer rotates in the forward direction, the hammer contact point moves along the curved rearward surface of the hammer so as to increase the effective lever arm of the bias force exerted on the hammer.

15. The method of claim 13 wherein:

the spring assembly further comprises a base mounted on the firearm so as to connect the hammer spring assembly to the firearm;

the spring is connected to the base; and the mounted base is further arranged to arrange the member and the spring relative to the hammer with the spring exerting the bias force on the member and the member exerting the bias force on the hammer.

16. The method of claim 15 wherein:

the firearm comprises a rifle; and the base is mounted on a lower tang of the rifle so that the bias force urges the member against the curved rearward surface of the hammer, wherein (i) the curved rearward surface of the hammer comprises two substantially straight portions and a concave circular arc portion tangent to the straight portions, (ii) the straight portions extend rearward and downward at angles of about 45° and about 68°, respectively, with respect to a vertical front surface of the hammer, and (iii) the circular arc portion has a radius of about 0.36 inches and a center of curvature about 0.325 inches above and about 0.36 inches behind the hammer pivot point.

17. The method of claim 13 wherein the member comprises one or more rolling bearings rotatably connected to the member and arranged to roll along the rearward surface of the hammer at the hammer contact point as the hammer rotates.

18. The method of claim 13 wherein:

the spring comprises a coil spring;

the spring assembly further comprises a spring shaft positioned longitudinally within the coil spring and a spring shaft guide arranged to receive therethrough the spring shaft and to permit reciprocating motion of the spring shaft; and a forward end of the spring shaft is connected to a rearward end of the member.

19. The method of claim 13 wherein (i) the curved rearward surface of the hammer comprises two substantially straight portions and a concave circular arc portion tangent to the straight portions, (ii) the straight portions extend rearward and downward at angles of about 45° and about 68°, respectively, with respect to a vertical front surface of the hammer, and (iii) the circular arc portion has a radius of about 0.36 inches and a center of curvature about 0.325 inches above and about 0.36 inches behind the hammer pivot point.

20. The method of claim 13 wherein the member is arranged to exert the bias force on the hammer at only a single hammer contact point that moves substantially continuously along the curved rearward surface of the hammer as the hammer rotates.

21. A method comprising providing a hammer spring assembly and instructing a user to connect the hammer spring assembly to a firearm, wherein:

the hammer spring assembly comprises (i) a spring and (ii) a member arranged to operatively couple the spring and a hammer pivotably connected to the firearm so that the spring biases rotation of the hammer about a hammer pivot point in a forward direction toward a cartridge or firing pin;

the member and the spring are arranged so that the spring exerts a bias force on the member in the forward direction;

the member is arranged so that the bias force urges the member against a curved rearward surface of the hammer at a hammer contact point to exert the bias force on the hammer;

the member and the spring are arranged relative to the hammer, when the hammer spring assembly is connected to the firearm, so that as the hammer rotates, the hammer contact point moves along the curved rearward surface of the hammer so as to cause a desired variation of an effective lever arm about the hammer pivot point of the bias force exerted on the hammer to rotate the hammer in the forward direction;

the member comprises a strut arranged to push against the hammer with a forward end of the strut at the hammer contact point and with a rearward end of the strut connected to the spring;

the hammer spring assembly further comprises one or more rolling bearings at a connection point between the strut and the spring that are arranged to guide forward and rearward movement of the connection point between the strut and the spring; and the one or more rolling bearings are rotatably mounted on a bearing shaft, and the strut is pivotably connected at its rearward end to the spring by the bearing shaft.

22. The method of claim 21 wherein the member and the spring are arranged relative to the hammer, when the hammer spring assembly is connected to the firearm, so that (i) as the hammer rotates in a rearward direction, the hammer contact point moves along the curved rearward surface of the hammer so as to decrease the effective lever arm of the bias force exerted on the hammer, and (ii) as the hammer rotates in the forward direction, the hammer contact point moves along the curved rearward surface of the hammer so as to increase the effective lever arm of the bias force exerted on the hammer.

23. The method of claim 21 wherein:

the spring assembly further comprises a base mounted on the firearm so as to connect the hammer spring assembly to the firearm;

the spring is connected to the base; and the mounted base is further arranged to arrange the member and the spring relative to the hammer with the spring exerting the bias force on the member and the member exerting the bias force on the hammer.

24. The method of claim 23 wherein:

the firearm comprises a rifle; and the base is mounted on a lower tang of the rifle so that the bias force urges the member against the curved rearward surface of the hammer, wherein (i) the curved rearward surface of the hammer comprises two substantially straight portions and a concave circular arc portion tangent to the straight portions, (ii) the straight portions extend rearward and downward at angles of about 45° and about 68°, respectively, with respect to a vertical front surface of the hammer, and (iii) the circular arc portion has a radius of about 0.36 inches and a center of curvature about 0.325 inches above and about 0.36 inches behind the hammer pivot point.

25. The method of claim 21 wherein the member comprises one or more rolling bearings rotatably connected to the member and arranged to roll along the rearward surface of the hammer at the hammer contact point as the hammer rotates.

26. The method of claim 21 wherein:

the spring comprises a coil spring;

the spring assembly further comprises a spring shaft positioned longitudinally within the coil spring and a spring shaft guide arranged to receive therethrough the spring shaft and to permit reciprocating motion of the spring shaft; and a forward end of the spring shaft is connected to a rearward end of the member.

27. The method of claim 21 wherein (i) the curved rearward surface of the hammer comprises two substantially straight portions and a concave circular arc portion tangent to the straight portions, (ii) the straight portions extend rearward and downward at angles of about 45° and about 68°, respectively, with respect to a vertical front surface of the hammer, and (iii) the circular arc portion has a radius of about 0.36 inches and a center of curvature about 0.325 inches above and about 0.36 inches behind the hammer pivot point.

28. The method of claim 21 wherein the member is arranged to exert the bias force on the hammer at only a single hammer contact point that moves substantially continuously along the curved rearward surface of the hammer as the hammer rotates.

* * * * *